United States Patent [19]

Crossman et al.

[11] 4,189,876

[45] Feb. 26, 1980

[54] BEAM-MOUNTED FOLDING CHAIRS

[75] Inventors: Philip E. Crossman; Arthur L. Van Ryn, both of Grand Rapids, Mich.

[73] Assignee: American Seating Company, Grand Rapids, Mich.

[21] Appl. No.: 931,562

[22] Filed: Aug. 7, 1978

[51] Int. Cl.[2] ..... E04H 3/12

[52] U.S. Cl. ..... 52/9

[58] Field of Search ..... 52/8–10; 297/332, 236

[56] References Cited

U.S. PATENT DOCUMENTS

| | | | |
|---|---|---|---|
| 2,987,111 | 6/1961 | Walworth | 52/9 |
| 3,025,106 | 3/1962 | Evans et al. | 297/248 |
| 3,170,199 | 2/1965 | Martin | 52/8 |
| 3,228,723 | 1/1966 | Barofsky | 297/35 |
| 3,316,014 | 4/1967 | Barecki | 297/35 |
| 3,352,069 | 11/1967 | Curra | 52/9 |
| 3,443,835 | 5/1969 | Brunskole | 297/35 |
| 3,464,753 | 9/1969 | Van Ryn | 297/232 |
| 3,656,806 | 4/1972 | Castelli | 297/324 |
| 3,690,726 | 9/1972 | Van Ryn | 297/332 |
| 3,703,312 | 11/1972 | Chapman | 297/35 |
| 3,713,618 | 1/1973 | Hendrickson et al. | 248/417 |
| 3,756,166 | 9/1973 | Piretti | 108/6 |
| 3,762,765 | 10/1973 | Piretti | 297/162 |
| 4,063,392 | 12/1977 | Van Ryn | 52/9 |
| 4,155,202 | 5/1979 | Hartman | 52/9 |

*Primary Examiner*—J. Karl Bell

*Attorney, Agent, or Firm*—Emrich, Root, O'Keeffe & Lee

[57] ABSTRACT

Seating for a telescoping row system or the like includes a chair back and seat mounted to a frame which automatically raises and lowers as the rows are opened and closed respectively. A pair of hinge mechanisms are clamped to the frame at the side of each chair for mounting the seats and backs while permitting them to rotate about a common axis which extends along the intersection of the hip and lumbar region of the occupant. The hinge mechanisms include one spring which normally biases the seat of the chair to the three-quarters fold position when it is unoccupied, but permits it to be lowered for an occupant or moved to the fully raised position for passing. In one embodiment, a second spring biases the back of each chair to the use position when the chair is raised. When the chair is folded for storage, the back and seat are rotated toward each other to a fully closed position. Seat, back and arm rest constructions are also disclosed which are particularly advantageous to telescoping row systems, although not so limited in application.

13 Claims, 15 Drawing Figures

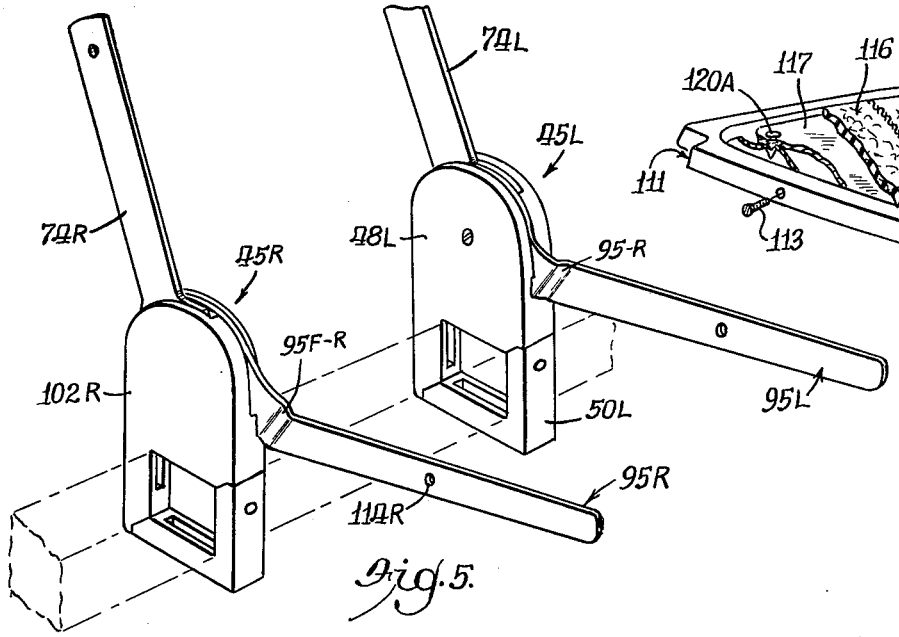
Fig. 5.
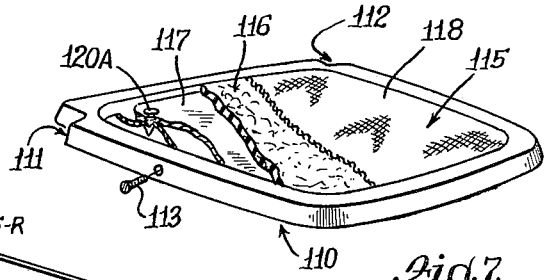
Fig. 7.
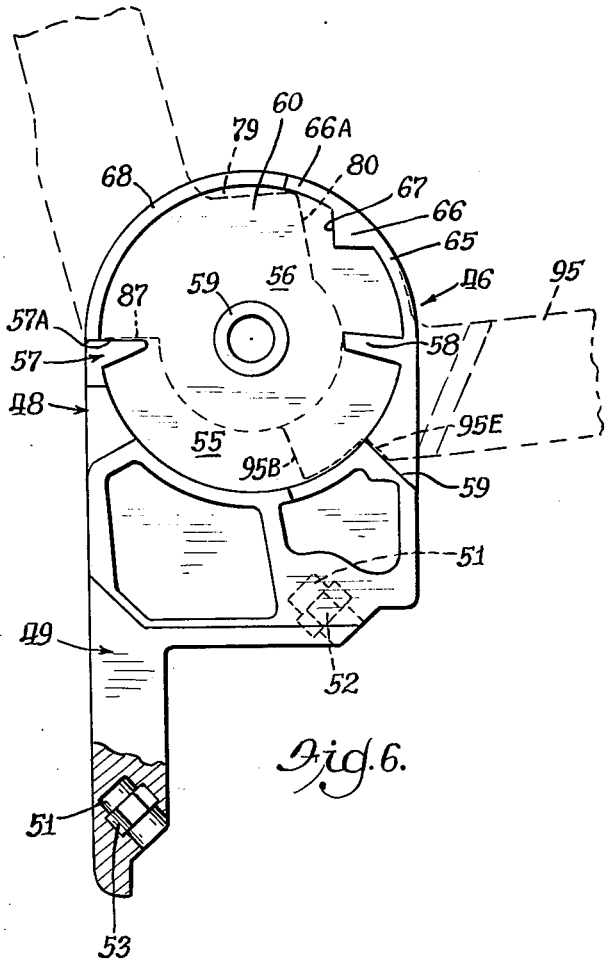
Fig. 6.
Fig. 8.
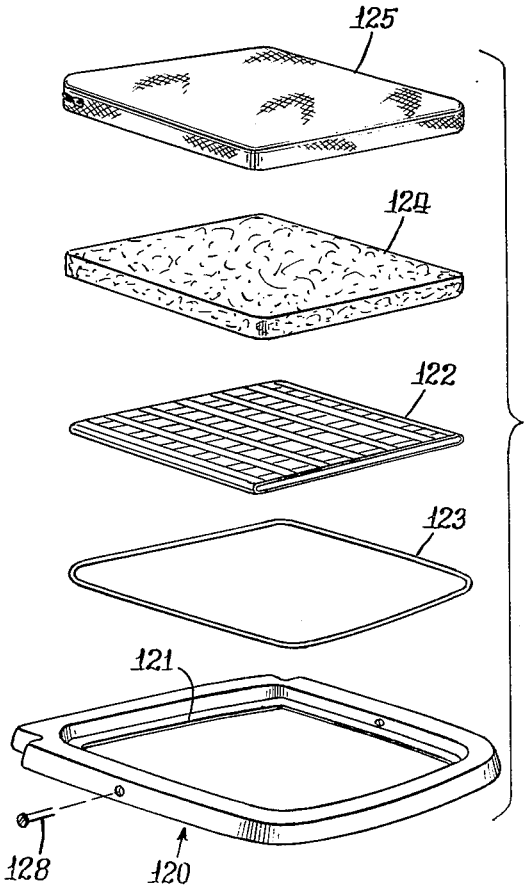

Fig. 9.
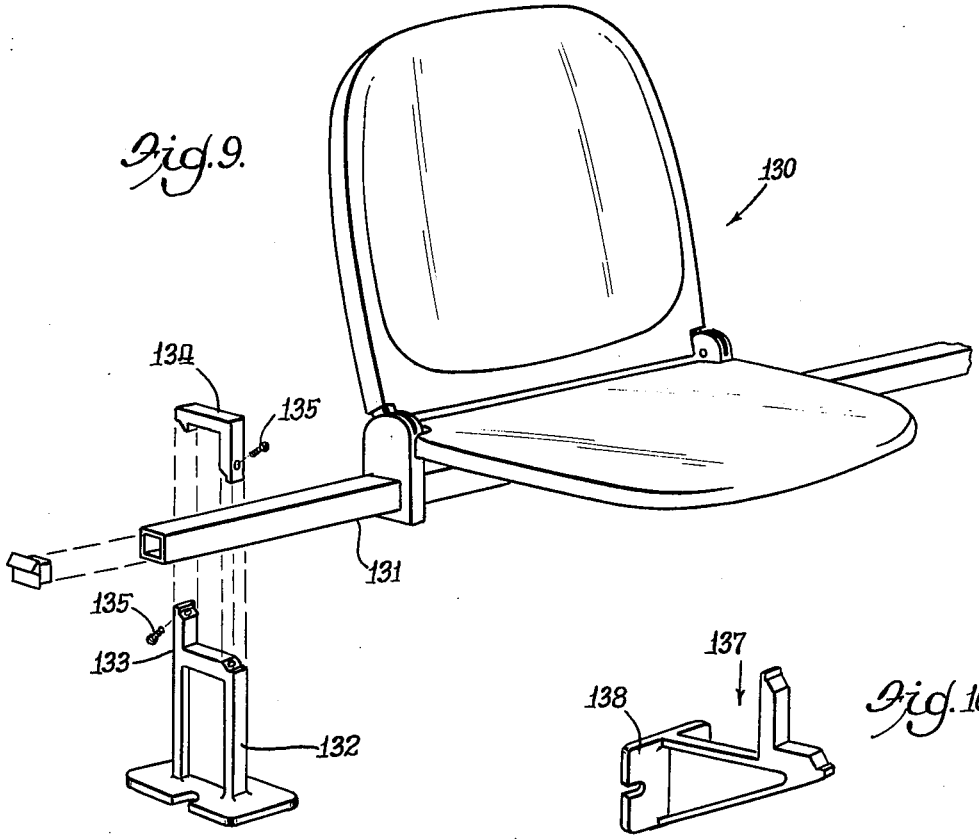
Fig. 10.
Fig. 11.
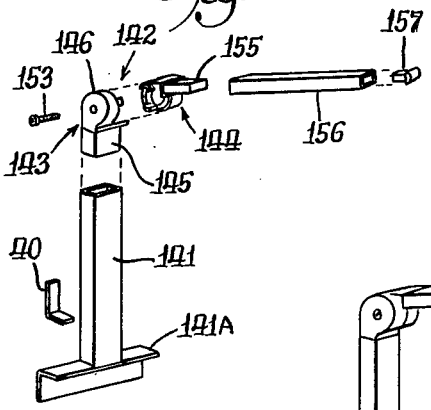
Fig. 14.
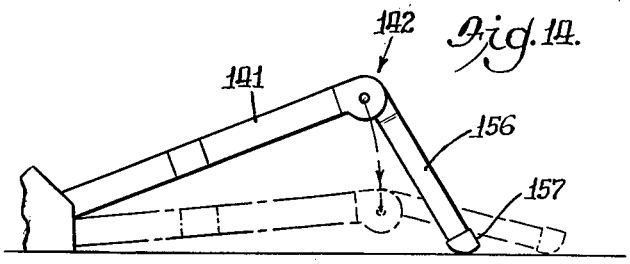
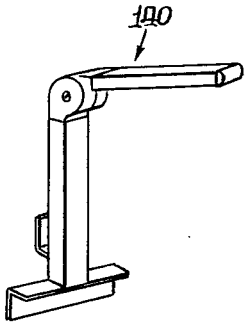
Fig. 12.
Fig. 13.
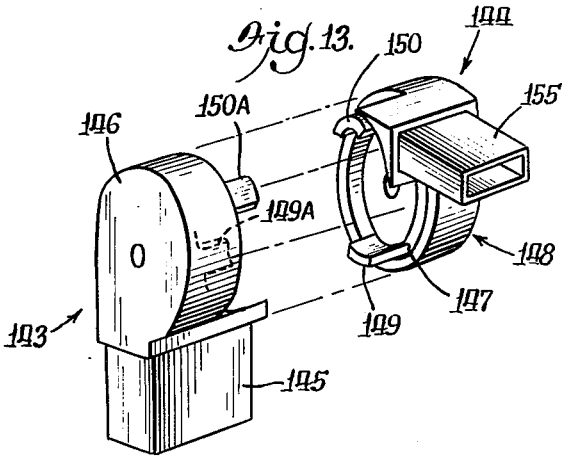
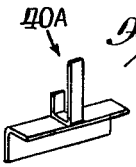
Fig. 15.

BEAM-MOUNTED FOLDING CHAIRS

BACKGROUND AND SUMMARY

The present invention relates in general to telescoping seating systems. Seating systems of this type include a plurality of rows which are mounted on wheel carriages and adapted to move between an extended use position in which the rows are stepped or tiered, and a retracted or storage position in which the rows are generally vertically aligned. The present invention is directed to seating for telescoping rows of this type; and it has particular utility in such systems wherein the seating is automatically raised when the rows are extended for use, and automatically lowered when the rows are retracted for storage. One telescoping row system which automatically raises and lowers the seating as the rows are extended and retracted is disclosed in the co-owned application of Hartman, for TELESCOPING SEATING SYSTEM WITH AUTOMATICALLY FOLDING CHAIRS, Ser. No. 897,941, filed Apr. 3, 1978 now U.S. Pat. No. 4,155,202. In the Hartman application, there is disclosed a mechanism responsive to the extension and retraction of the rows for raising and lowering a frame, including a horizontal beam, on which the seating is mounted.

The preferred embodiment of the present invention is illustrated as mounted on a horizontal beam of the type disclosed in the Hartman application, Ser. No. 897,941, now U.S. Pat. No. 4,155,202 which is raised and lowered with the movements of the telescoping rows; and it includes a chair back and seat mounted to the beam by means of a pair of hinge mechanisms clamped to the beam at the side of each chair. The hinge mechanisms include a pair of pocket washers which capture and hold a preloaded coil spring so that the washers are normally biased with their spring pockets aligned. A seat sector is engaged by one of the washers which is rotatable relative to the other washer which is fixed in a housing for the hinge mechanism. The seat sector is forced by the preloaded spring, when the seat is unoccupied, to the three-quarters fold position. Thus, when the system is extended for use, and the seats are unoccupied, they are all aligned in the three-quarters fold position, thereby facilitating ingress and egress, reducing maintenance cost for folding seats, and presenting a uniform, neat appearance to the system.

The hinge mechanisms permit the seat to be lowered to the horizontal position when occupied, and they also permit the seat to be further raised, as when an occupant steps rearwardly into the seat, pushing the top of the seat with the back of his thighs so as to facilitate passing by another occupant of the aisle. This position of the seat is sometimes referred to as the "passing" or fully closed position, and it is also assumed when the chair is lowered and stored in the space between adjacent decks when the system is closed for storage.

A second spring located in the same housing as the seat hinge mechanism normally biases back sectors, on which the chair backs are mounted, rearwardly to the normal use position when the seat is open, but they also permit the backs to be rotated forwardly to the fully closed position. This is also useful in that the backs do not bind when the rows are opened or closed out of the ordinary sequence. When the chairs are closed, both the seats and backs are rotated to a minimum space, occupying as little as 3½ inches of vertical space, and fitting within the space between the top of one deck and the bottom of the next higher deck, without requiring any special structural changes to the decks to accommodate the automatically folded chairs. This enables the chairs to accommodate a rise as low as 8 inches (deck-to-deck).

To provide more comfortable contour seating in this minimum space, one illustrated embodiment of the seat includes a peripheral frame which is mounted on seat sectors and which receives a seat panel comprising a wire frame, a sleeve or belt of flexible, elastic material on the wire frame, a foam cushion encompassing the belt, and a covering. When an occupant sits on the seat, the elastic belt will yield under the weight of the occupant, permitting his body contour to extend beneath the horizontal extension of the peripheral frame.

Various modifications of upholstery for backs and seats are also disclosed which are all capable of being folded into the minimum space necessary for automatically folding the seating between telescoping rows. There is also disclosed an arm rest structure which may be clamped to the same beam on which the seats are mounted, by the same clamping structure which holds the chair hinge mechanism. The arm rest is also capable of being folded when the rows are retracted, and it falls under gravity to the use position when the rows are extended for use.

The seating of the present invention is not necessarily limited for use with telescoping rows. Rather, as will be appreciated from the detailed description, it can be extended to a number of different applications, such as fixed seating, modular seating, and so on, as further explained below.

Thus, the present invention provides a chair which is capable of operating with a fully automatic telescoping row system and folding and unfolding in cooperation with the movement of the rows without sacrificing the comfort of an occupant. The system further provides the advantages and neatness of appearance in a three-quarters fold seat which may be lowered for use or further raised for passing. In addition, the limited pivotal motion permitted by the back permits location of the chair as close as desired to the rear of a deck consistent with tolerances required for positioning the nose of the next higher platform. This structure permitting limited rotation of the back further provides for increased passing space in the next higher row, when required. All of this is provided in a chair which may be folded into a space as small as 3½ inches deep so that the chair may be fully enclosed in the space between the top of one platform and the bottom of the next higher deck. The capacity to include a variety of different seating surfaces is a further advantage of the present system, these seating surfaces ranging from plastic, to a thin cushion pad, to a deeper cushion pad, and including a deep resilient sling for greater body contour.

Other features and advantages of the present invention will be apparent to persons skilled in the art from the following detailed description of alternative embodiments wherein identical reference numerals will refer to like parts in the various views.

THE DRAWING

FIG. 5 is a perspective view of a pair of hinge mechanisms for one chair;

FIG. 6 is an interior side view of the hinge casting of FIG. 4 showing the seat and back sectors in the limit positions for use;

FIG. 7 is a perspective view of a padded seat;

FIG. 8 is an exploded perspective view of a seat structure employing a resilient web or belt;

FIG. 9 is a perspective view of the seating system shown with the beam mounted on a fixed vertical standard, with some parts in exploded relation;

FIG. 10 is a perspective view of a fixed riser mount which might be used with the seating of the present invention;

FIG. 11 is an exploded perspective view of a folding arm rest used with the present invention;

FIG. 12 is a side view of the assembled arm rest of FIG. 11;

FIG. 13 is a detailed perspective view of the arm hinge members shown in exploded relation;

FIG. 14 is a perspective view of the arm rest of FIGS. 11 and 12 illustrating the angle of the arm rest as it engages a platform during folding and showing the arm in the folded position in dashed line; and FIG. 15 is a perspective view of a lift hook used in a system that does not have arm rests.

DETAILED DESCRIPTION

Figure 1:
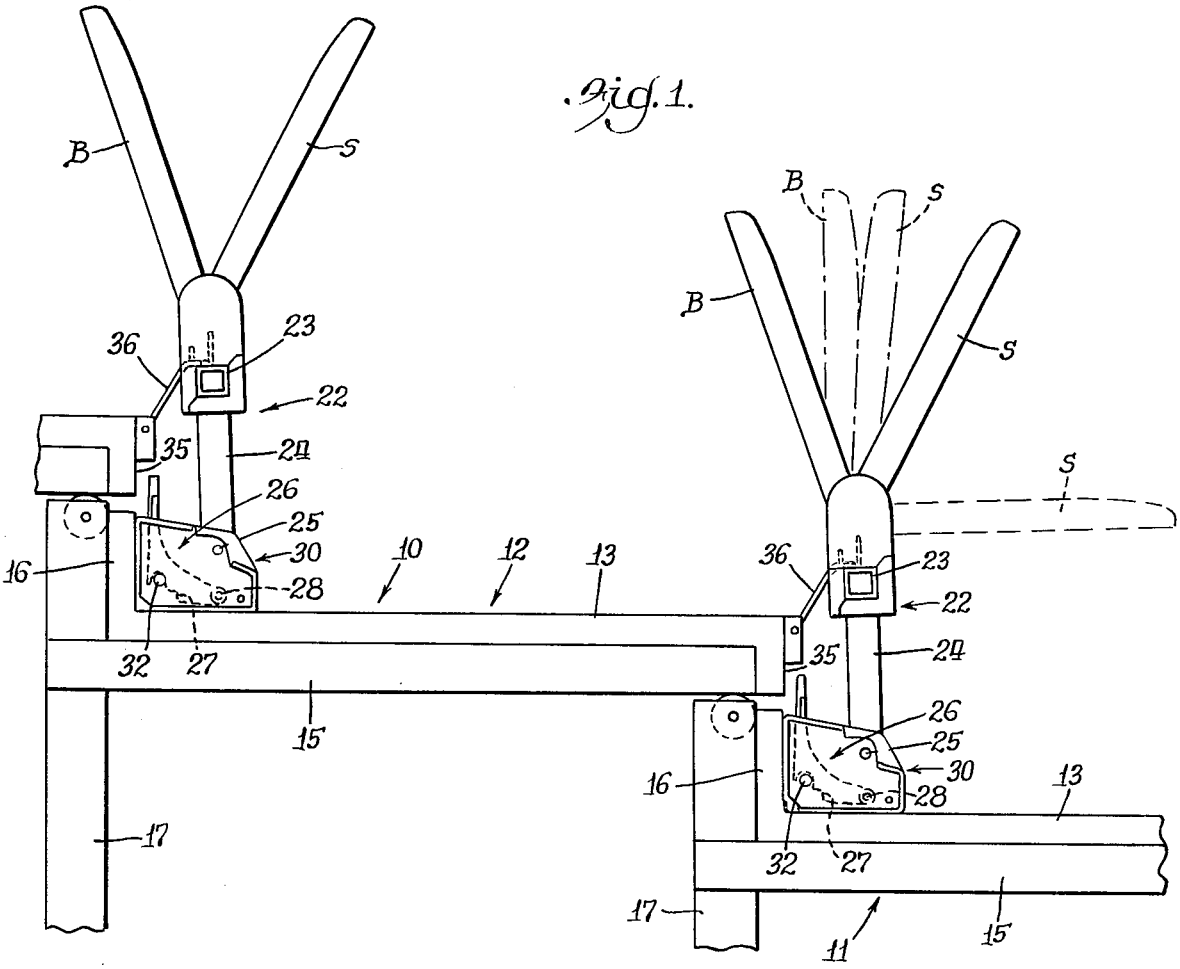
FIG. 1 is a fragmentary side view of a part of a telescoping row system incorporating the present invention, with the seats and backs shown in the normal, unoccupied position in solid line and in the various other positions in dashed line.
Figure 2:
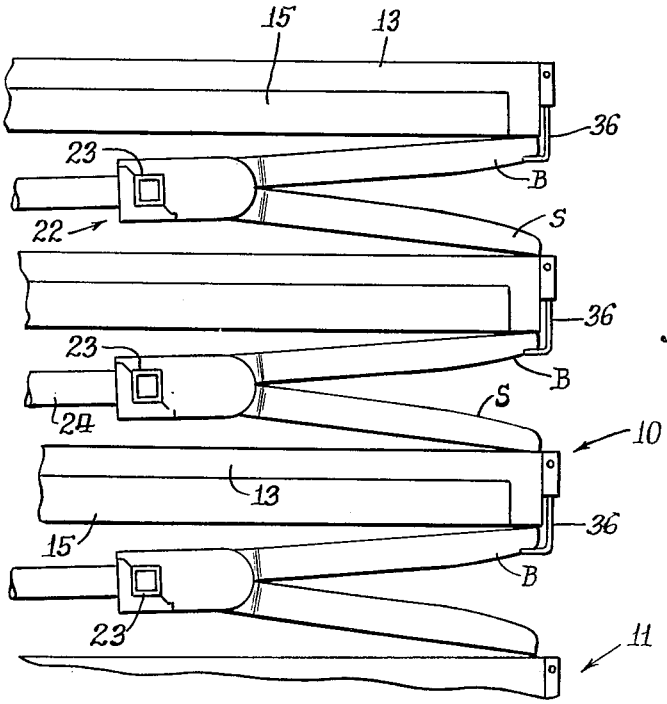
FIG. 2 is a view similar to FIG. 1 with the rows closed and the seating stored in the space between adjacent decks.

Referring first to FIG. 1, a portion of a telescoping row system is shown, including an upper row generally designated 10, and a lower row designated 11. Each of the rows may be similar in structure. Referring then to the row 10, it includes a deck 12 including a platform 13 supported on cantilever arms, one of which is shown at 15. The rear of the deck 13 includes a rear riser 16 which is mounted to an understructure including a pair of posts, one of which is seen at 17. The cantilever arms 15 are also welded to the posts 17. The posts, in turn, are welded to wheel carriages, as is well known in this art, for moving the rows between an extended use position (in which the rows are stepped as seen in FIG. 1) and the retracted storage position (in which the rows are generally vertically aligned as seen in FIG. 2).

In a system of this type the wheel carriages for the upper rows are spaced progressively further apart so that the wheel carriages of lower rows nest between them in side-by-side relation when the rows are closed. Additional details of row structure, including the apparatus for supporting a deck while permitting it to be moved between the extended and retracted positions may be found in U.S. Pat. No. 3,667,171, issued June 6, 1972, or U.S. Pat. No. 4,041,655, issued Aug. 16, 1977.

Turning now to the seating, in the illustrated embodiment, a tubular metal frame generally designated 22 includes a horizontal beam 23 and a plurality of stanchions 24 welded to it. The stanchions 24 are pivotally mounted at 25 to a locking mechanism generally designated 26. A plurality of chairs, each including a seat S and a back B is mounted to the beam 23.

The locking mechanism 26 is more completely disclosed in the co-owned application of A. P. Hartman for TELESCOPING SEATING SYSTEM WITH AUTOMATICALLY FOLDING CHAIRS, Ser. No. 897,941, filed Apr. 3, 1978 now U.S. Pat. No. 4,155,202. Briefly, however, it includes a locking lever 27 which is pivotally mounted at 28 to the bottom of a stanchion. The stanchion, in turn, as mentioned, is pivotally mounted at 25 to the side plates of a housing generally designated 30 which is secured to the riser and to the platform of a deck. In the raised position, the locking member 27 engages a pin 32 to hold the frame in the raised position.

During closing of the rows, the nose portion 35 of the next higher row engages the top of the locking member 27, unseats it, and permits the seating to be lowered to the closed position shown in FIG. 2.

As disclosed more fully in the above-identified Hartman application, an actuator 36 in the form of a hook is pivotally mounted to the nose portion of a row for engaging a lift hook on the arm rest such as that designated 40 in FIG. 11 for raising the seating when the rows are extended for use. If the arm rest is not used, a lift hook such as the one designated 40A in FIG. 15 is clamped to the beam by the hinge mechanisms to be described for the same purposes. Further, a torsion rod (not shown) is used to partially counterbalance the weight of the frame and chairs, and it also assists in raising and lowering the chairs.

Figure 3:
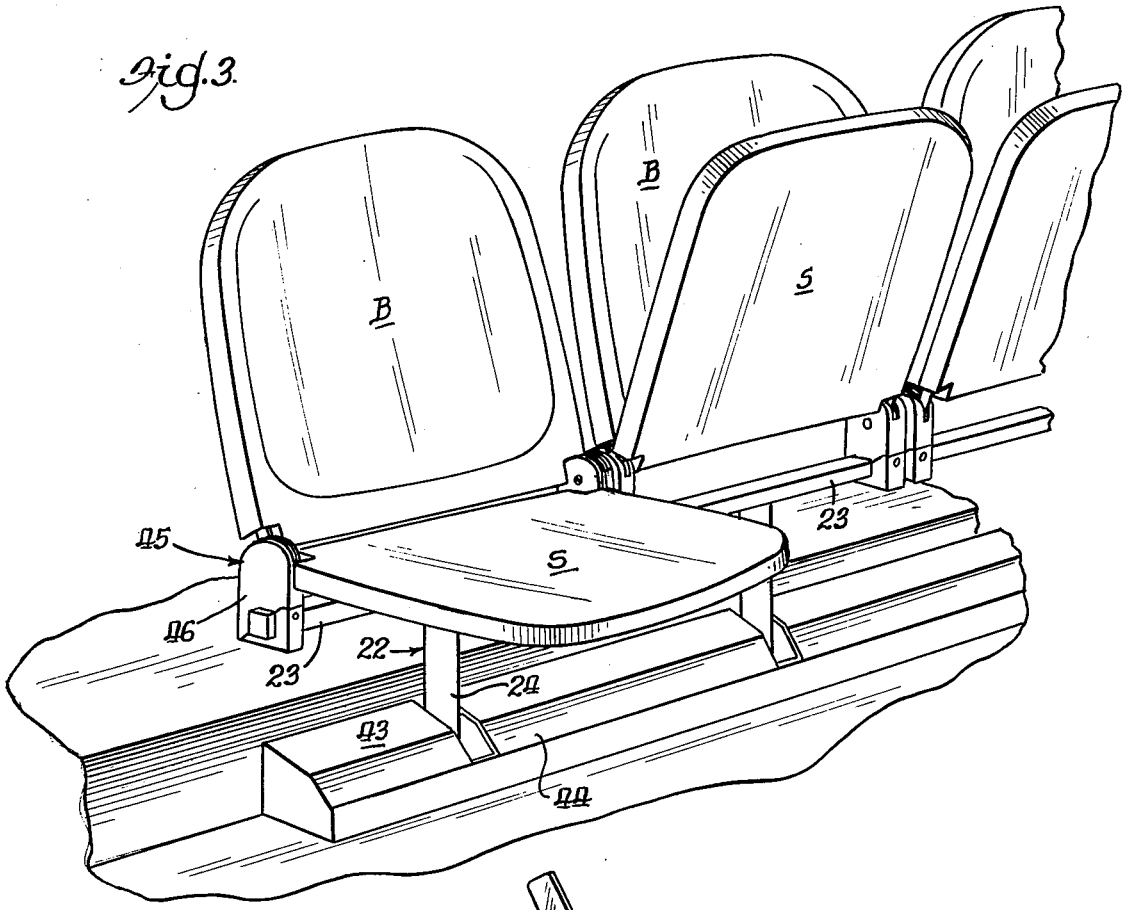
FIG. 3 is a fragmentary upper, right side perspective view of the system of FIG. 1.

Turning now to FIG. 3, the present invention is directed to the chair seating which, in this embodiment, is mounted directly to the beam 23 of the frame 22. The locking mechanism and housing 30 for the stanchions 24 is hidden by cover plates 43, 44. Each chair includes, as indicated, a back B and a seat S. The seat and back are mounted to the beam at each side by left and right (in reference to an occupant of the chair) hinge mechanisms generally designated 45L and 45R (in FIG. 5). The seats and backs pivot about a common axis which is defined by the intersection of the hip/lumbar region of an occupant of a chair, for greater comfort and support. In FIG. 1 for row 11, the back B and seat S are seen in solid line in the normal use positions and in chain line in the fully folded position (also the passing position for the seat). The seat is also seen in dashed line in the use position.

The right and left hinge mechanisms are similar to each other except that they form mirror images of each other, so that only one need be disclosed in more detail for a complete understanding of the invention.

Figure 4:
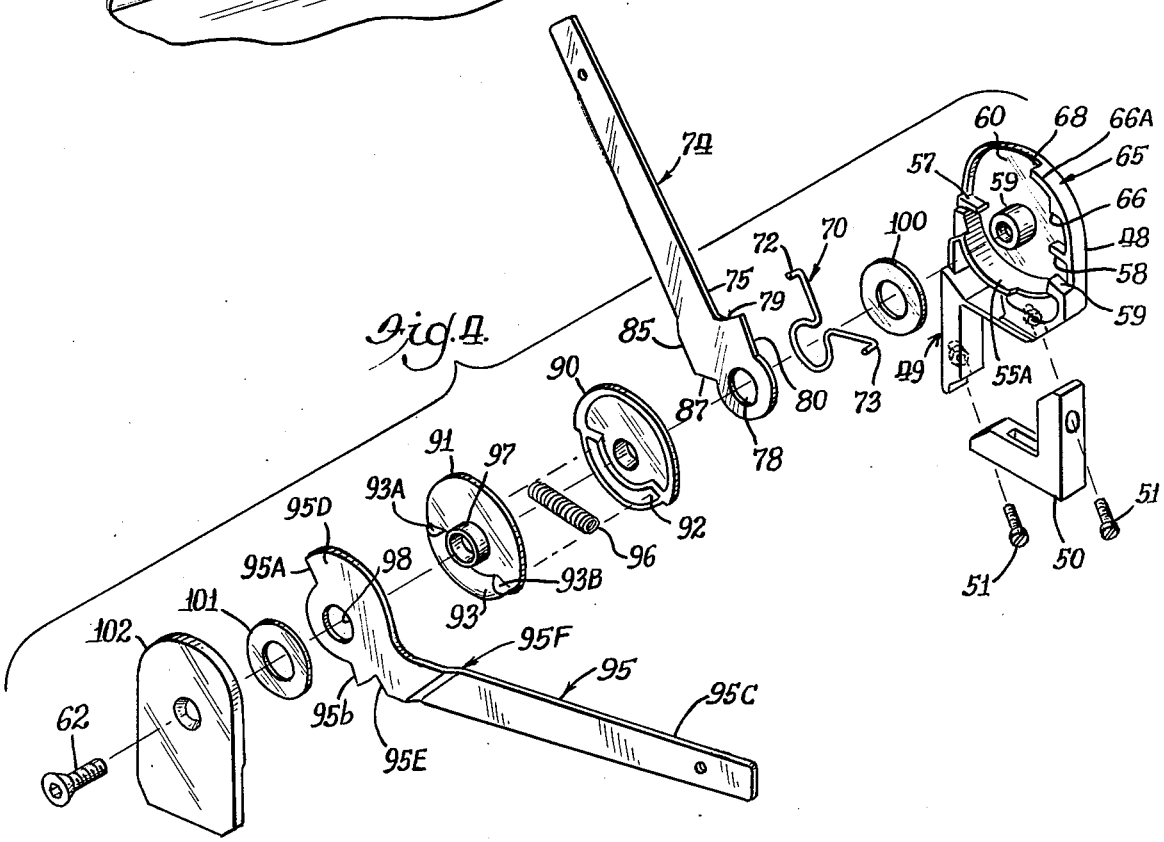
FIG. 4 is an exploded view of a right side hinge mechanism.

Referring then to FIGS. 4 and 6 for the left hinge, a housing 46 includes a casting 48 which includes a lower angle mounting portion 49 which conforms to the top and rear surface of the beam 23. A beam clamp 50 conforms to the front and lower surface of the beam 23 and is secured to the mounting portion 49 by bolts 51 which are received in threaded nuts embedded in the casting 48 and designated 52 and 53 in FIG. 6.

Turning now to FIG. 6, the casting 48 includes a lower cavity 55 and an upper cavity 56 separated by first and second inwardly extending projections 57, 58. The cavities 55, 56 are generally semi-circular in shape, and taken together, they have the general shape of a complete circle. A central hub 59 which extends inwardly of these cavities is integrally formed with a side wall 60 on the casting 48. The hub is internally threaded for receiving a flat head cap screw 62 which holds the hinge assembly together, as will be described. A third inwardly extending projection 66 is formed in an upper curved wall 65 of the casting 48, and it defines a stop surface 67 for the forward motion of the back sector, to be described. A lateral recess 68 (best seen in FIG. 4) is formed in the casting 48 to permit the back sector to rotate, as will be described. An extension 66A of the curved wall 65 extends above a portion of the back hinge sector to avoid "pinch" areas.

Returning now to FIG. 4, a back return spring generally designated 70 is received in the casting 48. It includes a central curved portion 71 which fits about the hub 59, and first and second outwardly bent end portions 72, 73. When a back hinge sector 74 is to be biased rearwardly, the portion 73 of the spring 70 engages the projection 58 of the casting, and the spring is preloaded by placing the portion 72 against the front edge of the back hinge sector 74, as at 75 in FIG. 4. In this manner, the back hinge sector is urged in counterclockwise rotation about the hub 59 on which an aperture 78 of the back hinge sector is rotatably received. The spring 70 may be reversed to bias the back sector forwardly, in which case the spring is rotated so that the bent end projection 72 of the spring engages the projection 57 on the casting, and the end 73 of the spring engages the rear edge of the back hinge sector 74.

Just beneath the location 75 on the back hinge sector 74, the back hinge sector extends forwardly at 79 and then downwardly at 80. The forwardly extending portion 79 is dimensioned to fit beneath the upper curved extension 66A of the casting 48 which extends rearwardly of the stop surface 67 on the inwardly extending projection 66 (see FIG. 6). The downwardly extending portion 80 of the back hinge sector engages the stop surface 67 to limit the forward motion of the back hinge sector 74 and back B. The portion 79 of the back hinge sector lies beneath the extension wall 66A of the casting for all positions of the back sector so that there is a smooth conformation from the curved wall 65 of the housing to the back sector during movement of the back; and no "pinch" areas are present.

To the rear of the back hinge sector 74 a lobe 85 is formed which defines a lower stop surface 87 which engages the upper surface 57A of the casting projections 57 to limit the rearward rotation of the back hinge sector and back.

Also received on the hub 59 spaced inwardly of the back hinge sector 74 are a pair of spring pocket washers 90, 91 which are similar in shape but reversed on the hub 59. Thus, the washer 90 includes a spring pocket 92, and the washer 91 includes a spring pocket 93. The pockets 92, 93 are semi-circular in cross section. Together, they form a portion of a toroid having its axis curved about the hinge axis for the seat sectors, to be described. The ends of the pocket 92 are trapped beneath the projections 57, 58 of the casting, so that washer 90 cannot rotate relative to the hinge casting 48.

A seat hinge sector 95 includes an outwardly-extending arm 95C and a disc-shaped portion 95D which defines a central aperture 98 which is received on a sleeve or bushing 97 which is an integral part of the washer 91. The bushing 97 is received on the hub 59 of the casting 48, and provides a bearing surface for rotation of the washer 91. The portion 95B of the seat hinge sector lies flat against the side of the washer 91 when the seat hinge sector is assembled to it.

The disc-shaped portion 95D is cut away along two radial edges 95A and 95B which are spaced angularly apart so as to engage the ends 93A and 93B of the spring pocket 93 on the washer 91. Thus, as the seat hinge sector 95 is rotated to the lowered or use position, the edge 95B will engage the end 93B of the spring pocket 93, and cause the washer 91 to be rotated clockwise. Just forward of the edge 95B, the seat sector 95 is notched to form a stop surface 95E which engages a surface 59 on the casting 48 to limit the seat sector 95 to the lowered position (see FIG. 6). Just forward of the stop surface 95E, the seat hinge sector is offset at 95F so that the arm portion 95C of the seat hinge sector is aligned with the arm of the back sector 74.

Referring to FIG. 5, left and right hinge mechanisms are shown assembled, with a beam indicated in dashed line. Corresponding elements for the left side of a chair are indicated by an L, and for the right side by an R. It will be observed that the arms of the seat hinge sectors are offset outwardly relative to the center of a chair, and this is so that the arms of the seat sectors align in the same vertical planes as the corresponding back sectors, and the back sectors 74L and 74R are located outwardly of the center of the chair on the hub 59 for their associated hinge mechanisms.

A helical coil compression spring 96 (called the seat fold spring) is received in the pockets 92, 93 which cooperate to fully enclose it. The seat fold spring 96 is trapped by the cooperating ends of the pockets 92, 93 to urge them into an aligned position. To effect this, the spring is preloaded—that is, it is compressed before being fitted into the pockets to urge the ends of the pockets into alignment, but permitting the washer 91 to rotate relative to the hinge casting 48. When the pockets 92, 93 of the washers 90, 91 are aligned under the preload force of the seat fold spring 96, the seat hinge sector extends in the three-quarters fold position, as seen in solid line for the seat S in FIG. 1. Further, it will be observed that the axis of the seat fold spring 96 is curved about the axis of rotation of the seat sector 95 for all positions of that sector.

Turning now to FIG. 7, there is shown a blow-molded plastic seat shell generally designated 110 which has first and second sheaths or pockets 111, 112 formed in the sides for receiving the seat sectors 105, 95 respectively. The seat sectors are secured by means of screws in the side of the seat frame, one of which is shown at 113 for being threaded into an aperture 114 on the sector 105. The other sector is similarly held to the seat shell. A ¾ in. padded seat, in the embodiment illustrated in FIG. 7, is applied directly to the upper surface of the seat (or back panel) of the blow-molded shell, the pad being designated 115. In this embodiment, the seat pad 115 includes a foam cushion 116, a panel 117 and an upholstery cover 118. A plurality of "Christmas tree" fasteners 120A are secured to the panel 117, and received in corresponding holding apertures on the upper surface seat panel of the shell 110. If a thicker seat cushion is desired, the seat panel (that is, the upper wall of the plastic shell in which the pad 115 is mounted) can be routed out and removed, thereby providing room for a thicker cushion without increasing the depth which can then be mounted to a retainer ring conforming to the size of the cavity left when the seat panel is routed out. Further, the removed portion of the seat panel may be used as the panel 117 for the thinner version of seat pad. Obviously, if no cushion is desired whatever, the plastic shell alone may be used as the seat.

If still more comfort is desired, both the top surface and the bottom surface may be routed out from the shell leaving a frame such as that designated by reference numeral 120 in FIG. 8 (formed from a shell produced by the same mold as that which produced the shell 110 in FIG. 7). In this case, however, the area of the lower surface of the shell which is removed is smaller than the area of the removed upper panel, leaving a ledge 121. The seat cushion is formed by placing an elastic web, sleeve or belt 122 over a rigid steel frame 123, leaving the center free to sag and assume the contour of an occupant. The continuous belt of elastic webbing 122 is stretched and forced over the frame 123, so that it is always under tension. The belt material may be that which is sold under the mark SANGLATEX, made by Matiba Corporation. This subassembly is then placed in a mold and plastic foam 124 is injected into the mold and penetrates the upper and lower layers of the belt 122 to provide cushioning. The combined frame, webbing and foamed plastic are then covered with a fabric cover 125 having a rear zipper.

When assembled to the seat frame 120, the frame 123 rests on the ledge 121 and the same screw 128 which holds the seat frame 120 to the seat hinge sector extends over and traps the wire frame 123, thereby securing the seat cushion to the seat frame. When an occupant sits on this assembly, as indicated above, his body contour is permitted to extend below the ledge 121, thereby providing a greater feeling of comfort and conformation in a structure which has a very thin silhouette, as is required for telescoping row sections having a low rise.

The structure of the chair backs B may be similar to three of the seat versions discussed—namely, a blow-molded plastic shell, a plastic shell with a thin pad such as the seat pad 115, and a seat shell with the forward surface routed to provide a thicker pad, as described.

Referring now to FIGS. 9 and 10, there are illustrated two typical structures for accommodating the seating of the present invention to fixed mounts. In FIG. 9, the chair is generally designated 130, and it is mounted on a beam 131 as described above. A floor or tread-mounted, fixed pedestal 132 includes an upper angle-shaped seat 133 which is adapted to receive an inverted clamp member 134 for engaging the beam 131, and which is secured by threaded bolts 135. In FIG. 10, there is shown a fixed pedestal or mount generally designated 137 which is adapted to be mounted to a riser by means of a mounting plate 138. In this case, the mount or pedestal 137 is adapted to be mounted to a high riser, but a pedestal could be modified for any type of riser if fixed seating is desired.

Referring now to FIGS. 11–13, there is shown an arm assembly generally designated 140 which may be used in an automatic folding structure. An upright support 141 is welded to the top of an angle member 141A which forms a saddle conforming to the top and rear sides of the seating beam, and adapted to be clamped beneath adjacent hinge assemblies. That is, a right side seat hinge clamp assembly for one chair fits over the left side of the saddle 141A, and the left side hinge seat assembly of the chair to the right fits over the right side of the saddle.

The previously mentioned hook member 40 is welded to the back of the upright 141 and adapted to catch the previously described actuator 36 (see FIG. 1). At the top of the fixed upright 141 a hinge generally designated 142 is formed from identical hinge members 143, 144. The hinge member 143 includes a base 145 which is press-fit into the open top of the tubular upright 141. At its upper portion of each hinge member are disc-shaped elements 146, 148.

As seen best for the member 144, a pair of diametrically opposed teeth 149, 150 extend outwardly from a circular track 147; and a similar pair of teeth 149A, 150A are formed in a corresponding track for the hinge member 143. The teeth of the hinge member 144 are received in the track of the hinge member 143, and the teeth of the hinge member 143 are received in the track of member 144. The two hinge members are secured together by a rivet 153, which permits them to rotate relative to each other. The hinge member 144 includes a projection 155 which is received in a tubular arm rest 156, the end of which is closed by means of a cap 157 (FIG. 11).

The hinge members 143, 144 are preferably formed from a tough, low-friction material such as nylon; and their engaging surfaces are flat to permit the weight of the arm to rotate the hinge member 144 clockwise in FIG. 13 until the adjacent surfaces of the teeth 150, 150A and 149, 149A engage to stop the arm in the use position (FIG. 12).

Referring to FIG. 14, when the seating is lowered, the included angle of attack between the arm rest 156 and the platform is no greater than 60°. This permits the further lowering of the seating to rotate the arm 156 counterclockwise to the folded position shown in chain line. A relatively loose fit between the hinge members 143, 144 permits the arm rest to drop to the use position under force of gravity when the seating is raised for use.

It will be observed that there is a smooth conformation from the top of the arm rest 156 to the back of the upright support 141 for all positions of the two members of the arm rest hinge. This prevents the actuator 36 (of FIG. 1) on the nose of the next higher deck from engaging any portion of the arm rest other than the hook 40 (FIG. 11); and it further avoids any "pinch" areas for users regardless of the position of the arm rest.

OPERATION

Assuming that the seating is unoccupied, the seat S assumes the three-quarters fold position shown in solid line in FIG. 1. This is accomplished by the seat hinge mechanisms, and specifically by the preload of the seat fold spring 96 which acts to align the ends of pocket 93 of washer 91 with the ends of pocket 92 of washer 90 (FIG. 4). The washer 90 is restrained against rotation by the projections 57, 58 on the casting 48. The ends 93A and 93B of the pocket of washer 91 engage the edges 95A and 95B respectively on the seat hinge sector 95, and move it to the three-quarters fold position under urging by the spring 96.

The back B is urged rearwardly by means of the back return spring 70 when that spring is assembled so that the end projection 72 engages the forward edge of the back sector. This permits the back to be pivoted forwardly to the position shown in chain line for the lower row 11.

The articulation of the back B has a number of advantages. First, the back can assume any position over a continuous range without binding against the nose portion of the deck of the next higher row. This permits the system to accommodate much higher rises than are shown in FIG. 1 (it is sometimes desirable to increase the rise substantially for higher rows to enhance the viewing of occupants of upper rows). Further, the nose section of the highest rows, even in the extended position, may engage the rear of the chair back during sequencing of the rows, but an articulated back can accommodate such engagement without binding even where the rows are not completely opened. Further, the articulation of the back to a forward position permits additional passing room in the next higher row while stopping it after limited travel (surface 80 engaging stop surface 67 of FIG. 6) so that a person in the next higher row might use it as a hand rail.

When an occupant lowers the seat to the dashed position in FIG. 1, the inner washer 91 (of a left side hinge mechanism) which is engaged by the seat sector, rotates clockwise (FIG. 4) so that the end 93B of the pocket 93 compresses the seat fold spring 96 against the rear end of the pocket 92 of the washer 90 until the stop surface 95E on the seat sector abuts the surface 59 on the hinge casting to stop the seat in the use position.

If the occupant rises, the seat fold spring 96 will again cause the seat to assume the three-quarters fold position shown in solid line in FIG. 1. If the occupant then steps back, for example, to permit passage of another person in the same aisle, the surface 95A of the seat hinge sector will engage the end 93A of the pocket 93 on the washer 91, and cause the washer to rotate counterclockwise. The end 93A of the washer 91 compresses the seat fold spring forwardly against the forward end of the pocket 92 until the seat hinge sector engages the stop surface 59A on the casting 48. The passing position for the seat S is shown in chain line in FIG. 1. To fully fold the chair to the positions shown in chain line in FIG. 1, the back is rotated forwardly against the action of the back return spring 70, and the seat is rotated toward the back to the passing position. The combined seat and back are capable of being folded into a space no greater than 3½ inches high between the platform of one deck and the bottom of the next higher deck. The relationships shown in FIG. 2 are typical for a ten inch rise.

If the embodiment of FIG. 8 is used for the seat panel, as indicated above, the weight of the occupant may cause the stretch elastic belt 122 to sag beneath the ledge 121 on the seat frame 120, depending upon the weight of the occupant.

Facility of installation is achieved by means of the split clamp assembly wherein the lower clamp member and hinge casting interface cuts diagonally across the beam 23 of the frame 22, thereby permitting front access to the mounting screws. Further, the modularity in the chairs themselves is advantageous in accommodating the chairs to any spacing over a fixed spacing (such as 18 inches) without arms or a slightly wider spacing (such as 19 inches) with arms without modifications to the chair at the factory or at the site. The chairs and arms may be loosely assembled along a beam until the desired spacing is achieved, and then firmly clamped using only the clamp screws, which are accessible from one side.

The axes of rotation of the seats and backs are colinear and extend along a line representative of the intersection of the hip and lumbar regions of the occupant, for greater comfort.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In combination with a telescoping row system including a plurality of rows extendable to a use position in which the rows are in stepped relation, and retractable to a storage position in which the rows are generally vertically aligned, said system including seating means and automatic mechanism for raising said seating means to a use position when said rows are extended and for lowering said seating when said rows are retracted, improved seating comprising: frame means adapted for movement between a use and a storage position by said automatic mechanism; at least one chair carried by said frame means and movable therewith, said chair including a seat, a back and hinge means for mounting said seat and said back to said frame means for independent pivotal motion about horizontal axes; resilient means for biasing said seat to a raised position when it is unoccupied while permitting said seat to be lowered for occupancy; and means permitting said back to be pivoted forwardly for closing, said seat and back fitting in the vertical space between rows when said rows are retracted.

2. The apparatus of claim 1 wherein said means permitting said back to be pivoted forwardly comprises second resilient means for urging said back rearwardly to the use position while permitting it to be pivoted forwardly for closing and to accommodate different positions of the risers of higher rows.

3. The apparatus of claim 2 wherein said hinge means comprises first and second housing connected to said frame means for mounting said seat and back for independent pivotal motion about a common horizontal axis.

4. The apparatus of claim 1 wherein said resilient means comprises preloaded coil spring means for biasing said seat to a three-quarters fold position when it is unoccupied, said system further comprising pocket means rotatable with said seat and at least partially enclosing said spring means for compressing said spring means in a first direction when said seat is lowered for use, and for compressing said spring means in a second direction when said seat is raised beyond said three-quarters fold position.

5. The apparatus of claim 1 wherein said frame means includes a horizontal beam, and wherein said system includes a plurality of said chairs; said hinge means comprising first and second hinge mechanisms for each of said chairs, each hinge mechanism including a housing adapted to engage the top and one side of said beam when said beam is in the use position, a clamp adapted to engage said beam at the bottom and the other side thereof; and means for fastening said clamp member to said hinge mechanism mounting for securing said chair to said beam.

6. The apparatus of claim 5 further comprising arm rest means between adjacent chairs, each arm rest means including saddle means adapted to engage said beam and clamped thereto by an adjacent pair of said hinge mechanisms for said chairs, said arm rest means further including an upright member mounted to said saddle means, an arm, and pivot means for mounting said arm to said upright member, said pivot means permitting said arm to fall to the use position under gravity when said frame means is raised to the use position.

7. The apparatus of claim 6 wherein said hinge means for connecting said arm rest to said upright member includes first and second side hinge members each having an exterior curved surface conforming to the shape of the other member, and each including a rounded interior track and at least a first protruding tooth, the tooth of each hinge member extending into the track of the other and cooperating to define the use position of the arm rest member, said exterior conforming surfaces conforming to each other for all positions of said arm rest member to avoid catching any portion of the deck of the next higher row during extension and retraction of said row.

8. The apparatus of claim 5 wherein said hinge housing includes a casting, said system further including first and second internally threaded nuts embedded in said casting, said fastener means extending through said clamp member and received in said embedded nut.

9. The apparatus of claim 5 wherein said casting of each hinge means comprises a cavity defining a spring pocket having an axis curved about the axis of rotation of said seat; means connected to said seat defining a second spring pocket having an axis curved about the axis of rotation of said seat and cooperating with said first spring pocket to hold said spring, said spring acting to align said first and second spring pockets, said seat being in a raised position when said second spring pocket is aligned with said first spring pocket.

10. In combination with a telescoping row system including a plurality of rows extendable to a use position in which the rows are in stepped relation, and retractable to a storage position in which the rows are generally vertically aligned, said system including seating means and automatic mechanism for raising said seating means to a use position when said rows are extended and for lowering said seating when said rows are retracted, improved seating comprising: a frame including a beam actuated between a use and a storage position by said automatic mechanism; a seat; a back; and hinge means for mounting said seat and said back to said beam for independent pivotal motion about a common axis; first resilient means for biasing said seat to a three-quarters fold position when it is unoccupied while permitting said seat to be lowered for occupancy and raised beyond said three-quarters fold position for passing; and second resilient means for urging said back rearwardly about its pivot axis while permitting said back to be pivoted forwardly for closing, said seat and back fitting in the vertical space between rows when said rows are retracted.

11. In combination with a telescoping row system including a plurality of rows extendable to a use position in which the rows are in stepped relation, and retractable to a storage position in which the rows are generally vertically aligned, said system including seating means and automatic mechanism for raising said seating means to a use position when said rows are extended and for lowering said seating when said rows are retracted, improved seating comprising: a frame including a beam actuated between a use and a storage position by said automatic mechanism; a seat; a back; and hinge means for mounting said seat and said back to said beam for independent pivotal motion about a common axis, said hinge means permitting said back to be rotated between first and second limit positions; first resilient means for biasing said seat to a three-quarters fold position when it is unoccupied while permitting said seat to be lowered for occupancy and raised beyond said three-quarters fold position for passing; and second resilient means for resiliently urging said back about its pivot axis to said first limit position while permitting said back to be pivoted to said second limit position, said seat and back fitting in the vertical space between rows when said rows are retracted.

12. The apparatus of claim 11 wherein said first and second limit positions of said back are a rear and a forward position respectively, said second resilient means urging said back about its pivot axis to said rear position while permitting said back to be pivoted forward for closing.

13. The apparatus of claim 11 wherein said first and second limit positions for said back are a forward and a rear position respectively, said second resilient means resiliently urging said back about its pivot axis toward said forward position while permitting said back to be pivoted rearwardly by an occupant.

* * * * *